United States Patent [19]

Chang et al.

[11] Patent Number: 4,594,130

[45] Date of Patent: Jun. 10, 1986

[54] PULPING OF LIGNOCELLULOSE WITH AQUEOUS ALCOHOL AND ALKALINE EARTH METAL SALT CATALYST

[76] Inventors: Pei-Ching Chang, 7211 Frances St., Burnaby, B.C.; Laszlo Paszner, 3906 W. 33rd Ave., Vancouver, B.C., both of Canada

[21] Appl. No.: 511,717

[22] Filed: Jul. 7, 1983

Related U.S. Application Data

[63] Continuation of Ser. No. 284,632, Jul. 20, 1981, abandoned, which is a continuation-in-part of Ser. No. 126,441, Mar. 18, 1980, abandoned, which is a continuation-in-part of Ser. No. 94,721, Nov. 27, 1979, abandoned.

[30] Foreign Application Priority Data

| | | | |
|---|---|---|---|
| Nov. 27, 1978 | [CA] | Canada | 316951 |
| May 22, 1979 | [DE] | Fed. Rep. of Germany | 2920731 |
| Jul. 25, 1980 | [CA] | Canada | 359443 |

[51] Int. Cl.[4] ..... D21C 3/20; D21C 11/00

[52] U.S. Cl. ..... 162/16; 162/37; 162/73; 162/77

[58] Field of Search ..... 162/37, 73, 76, 77, 162/81, 82, 16; 127/37, 43

[56] References Cited

U.S. PATENT DOCUMENTS

| | | | |
|---|---|---|---|
| 2,022,654 | 12/1935 | Dreyfus | 162/77 |
| 2,639,988 | 5/1953 | Zeehiusen | 162/77 |
| 3,652,385 | 3/1972 | Noreius | 162/23 |
| 3,701,712 | 10/1972 | Samuelson et al. | 162/65 |
| 3,725,194 | 4/1973 | Smith et al. | 162/65 |
| 3,887,426 | 6/1975 | Fogarasay | 162/77 |

FOREIGN PATENT DOCUMENTS

| | | | |
|---|---|---|---|
| 517204 | 7/1976 | Japan | 162/77 |
| 357821 | 10/1931 | United Kingdom | 162/77 |
| 371038 | 4/1972 | United Kingdom | 162/77 |
| 2040332 | 8/1980 | United Kingdom | 162/77 |

OTHER PUBLICATIONS

Chang et al., "Recovery and GC Analysis of Wood Sugars From Organosolv Saccharification of Douglas-Fir Heartwood", Sep. 76 Canad. Wood Chem. Symposium.

*Primary Examiner*—Peter Kratz
*Attorney, Agent, or Firm*—Ian C. McLeod

[57] ABSTRACT

High yield pulping is achieved by cooking a lignocellulosic material in a confined chamber in the absence of added oxygen at elevated temperatures up to 240° C. with an initially neutral or acidic mixture of alcohol and water in volume ratio between 50:50 and virtually anhydrous alcohol cooking liquor, using a lower aliphatic alcohol namely methanol, ethanol or n-propanol, carrying in solution at least about 0.002 moles per liter of a magnesium, calcium or barium salt as a primary catalyst soluble in at least catalytic amounts in the mixture to form barium, calcium and magnesium ions. The cooking time may range from at least two (2) minutes to under three (3) hours. The process yields bright, free-fiber pulp even at residual lignin of 80 Kappa number as high as 80% of softwood and up to 75% of hardwood weight, of viscosity (TAPPI 0.5% Cu En) above 18 up to 60 centipoise. Addition of trace amounts of an acidic compound as a secondary catalyst increases the rate of delignification. Elevated pressures on the cooking solvent mixture also increases the rate of delignification.

29 Claims, No Drawings

PULPING OF LIGNOCELLULOSE WITH AQUEOUS ALCOHOL AND ALKALINE EARTH METAL SALT CATALYST

This is a continuation of application Ser. No. 284,632, filed July 20, 1981 which is a continuation-in-part of application Ser. No. 126,441, filed Mar. 18, 1980 which is a continuation in part of application Ser. No. 094,721, filed Nov. 27, 1979, all abandoned.

BACKGROUND OF THE INVENTION

1. Field of the Invention

This invention relates to a novel process for treating lignocellulose in a confined chamber in the absence of added oxygen with an intially neutral or acidic solvent mixture comprised of water and a lower aliphatic alcohol having one to three carbon atoms, a dissolved magnesium, calcium or barium salt primary catalyst preferably augmented by a very minor amount of an acidic compound as a secondary catalyst by cooking at a temperature in the range 145° C. to about 240° C., to produce high yields of chemical pulp of strong separated cellulose fibers.

The process is particularly successful in producing high yields of pulp of separated fibers even with residual lignin contents exceeding 80 Kappa number without requiring mechanical refining to liberate fibers. Such pulps have nearly theoretical alpha-cellulose content and fiber strength only slightly below the strength of natural undegraded cellulose. The process is universally effective in treating the gymnosperm and angiosperm wood species as well as lignocellulosic plant materials such as bamboo, sugarcane, cereal plants and grasses.

2. Description of the Prior Art

The objectives in an ideal process for cooking lignocellulose are met when virtually all the lignin becomes solubilized in a short cooking time, with only an absolute minimum of other cell wall materials encrusting the cellulose fibers, while fiber yields almost equal to the total content of cellulose and hemicellulose are attained. Such efficient cooking would minimize the energy required in mechanical dispersion of the fibers after cooking and also minimize bleach chemical consumption.

For complete delignification the solubilization must proceed within the cell structure, not only to the fiber-cementing layers or middle lamella composed of lignin-carbohydrate matrix, but also to the cell wall matrices containing varying proportions of lignin and hemicelluloses. When virtually complete delignification of these structures has been reached the proportion of screened rejects will be very low and the cooked chips will require little if any mechanical agitation for full defiberization, saving on costs of process energy and preserving good fiber properties.

The prior art includes processes wherein wood is subjected to rapid hydrolysis in aqueous or aqueous-organic solvent mixtures containing acid and/or acidic salt catalyst compounds at temperatures in the range 100° C. to about 230° C. in a confined chamber in absence of added oxygen. The most important process is disclosed in United Kingdom Patent No. 357,821 to Kleinert and Tayenthal (1932), and includes an alcohol-water mixture containing slight quantities of inorganic or organic acid, or an acidic salt such as sodium bisulphite or sodium bi-sulphate.

The present invention is not related to basic hydrolysis of lignocellulosic materials which is also described by Kleinert et al which is a different process chemically. Basic hydrolytic agents such as alkali metal and alkaline earth metal oxides or hydroxides or basic salts such as sodium carbonate or magnesium carbonate are also described. The magnesium carbonate is used in the solvent mixture in the same manner as the oxides or hydroxides and is quite insoluble in alcohol and water at room temperatures thus providing few magnesium ions in solution. Magnesium carbonate was not used under acidic conditions by Kleinert et al.

In U.S. Pat. No. 2,951,775 to Apel it is proposed to hydrolyze wood with a lower aliphatic alcohol and a large proportion of hydrochloric acid. Saccharification is taught also by U.S. Pat. No. 2,959,500 to Schlapfer and Silberman using ethanol or n-propanol and water containing strong acid between 0.0125 N and 0.15 N at 170° C. to 180° C., who also disclose the use of ferrous ammonium sulphate as salt catalyst with sulphuric acid. At column 4, lines 17 to 35 and Examples 1 and 2 the use of metal salts generally is disclosed to be disadvantageous to the organosolv and hydrolysis process. Recovery of cellulose and of lignin from lignocellulose is proposed in U.S. Pat. No. 2,308,564 to McKee by cooking in water carrying a high concentration of alkali metal xylene sulphonate. U.S. Pat. No. 2,022,654 to Dreyfus describes a basic solvent process as does U.S. Pat. No. 2,022,664 to Groombridge et al.

U.S. Pat. No. 3,701,712 to Samuelson et al, U.S. Pat. No. 3,725,194 to Smith and U.S. Pat. No. 3,652,385 to Noreus describe an alkaline aqueous mixture for cellulose separation in the presence of added oxygen for delignification. Catalysts including magnesium, calcium and barium salts are used in the process. These basic processes vigorously attack the lignins so that they are severely degraded. These processes are different from the non-oxidation processes of Kleinert et al and require more elaborate processing equipment.

The present invention is in the same field as our co-pending U.S. application Ser. No. 248,023, filed Mar. 26, 1981, now U.S. Pat. No. 4,409,032, wherein processes are described for cooking with alcohol-water mixtures containing a selected organic acid or buffered inorganic acid, to produce pulps in very short times and to recover high quality soluble lignin and sugars.

In such acid-catalyzed organosolv processes (as well as the basic oxidation processes) although the lignin and sugar products are of considerable value, a major disadvantage from the standpoint of pulp acceptability for making paper is that the cellulose fibers are attacked throughout the cooking interval so that before an acceptably low residual lignin is reached, degradation of the cellulose chains will have occurred. The viscosity number of the cellulose will be much below that of the natural undegraded cellulose, so that paper sheets made from the pulps lack high breaking strength, tear and burst strength desirable for industrial paper products. Some degradation of lignin by acid-catalyzed recondensation and some conversion of sugars to dehydration products also occurs.

A further disadvantage of earlier alcohol-water cooks as exemplified in U.S. Pat. No. 3,585,104 to Kleinert and in U.S. Pat. No. 4,100,016 to Diebold et al is the poor solubility in the cooking solvent mixture of lignin which has become partially recondensed, causing blockage of micropores of the wood. Not only is severe undercooking of chip cores likely, but gummy deposits tend to form in pipes and cooking vessels when the cooking liquor is allowed to cool substantially below the cooking temperature.

SUMMARY OF THE INVENTION

It is accordingly an object of the present invention to produce from lignocellulosic materials high yields of pulp fibers of low residual lignin content by a novel process including cooking with alcohol-water mixtures catalyzed by calcium, magnesium and barium salt primary catalysts which are soluble in the mixture in the absence of added oxygen at an initially neutral or acidic pH.

It is another object to produce pulps by cooking wood with an alcohol-water solvent mixture using these salts with acidic compounds, preferably strong mineral acids as secondary catalysts.

Yet another object of the invention is to provide a delignification process wherein serious depolymerization of cellulose is low or even entirely prevented.

It is also an object to employ non-toxic salts as primary catalysts, so that direct fermentation of sugars recovered from the alcohol-water cooking process may proceed without prior removal of the catalyst.

Another object of the invention is to provide a process in which the acidic compound secondary catalyst and/or primary catalyst can be used in minor amounts so that polluting effects are negligible.

A further object of the invention is to provide an improved process for rapid and extensive delignification of lignocellulosic material employing an alcohol-water solvent mixture of very high alcohol-water volume ratio allowing use of extraordinarily elevated process temperatures without penalty of lignin condensation and agglomeration experienced in prior art organosolv cooking.

GENERAL DESCRIPTION

The present invention relates to the improvement in a process for converting lignocellulosic plant material to the form of separated fibers in which the plant material is cooked in a confined chamber in the absence of added oxygen with an initially neutral or acidic aqueous mixture of a lower aliphatic alcohol having one to three carbon atoms, wherein the mixture contains a catalyst promoting hydrogen ion or proton generation from the lignocellulose, at elevated temperature, which comprises:

cooking fragmented lignocellulosic material with an aqueous solvent mixture containing a major volume proportion of the alcohol and containing a catalytic amount of a magnesium, calcium or barium salt or mixtures thereof as a primary catalyst which is soluble in at least the catalytic amount in the mixture to form magnesium, barium and calcium ions dissolved therein at a temperature between 145° C. and 240° C.;

maintaining the cooking temperature for at least 2 minutes and sufficient to effect at least partial depolymerization and dissolution of lignin and hemicellulose and other cell wall constituents encrusting the cellulose fibers and to render the fibers separable from each other in a liquor residue containing dissolved lignin materials and sugars; and recovering the separated fibers from liquor residue. The primary catalyst salts all include an alkaline earth metal cation. Preferably the pressure on the solvent mixture in the chamber is elevated to above 15 atmospheres.

In accordance with one primary aspect of this invention, lignocellulosic materials are cooked at an elevated temperature in an alcohol-water mixture of methanol, ethanol or n-propanol, wherein the solvents are in volume ratio between about 50 to 50 parts up to substantially anhydrous alcohol and only a trace amount of water, employing as primary catalyst a dissolved salt which is selected from calcium, magnesium or barium salts such that calcium, magnesium or barium cations from the salt are present in the mixture. The concentration of the primary salt catalyst in the cooking mixture may be as low as 0.005 moles per liter, equivalent to less than 30 kg per tonne of wood cooked, far higher concentrations also being effective. The preferred primary catalyst is a salt of magnesium, calcium or barium having nitrate, chloride, sulphate or mixtures thereof as anions.

The present invention particularly consists in the method for pulping lignocellulose materials to fully separated fibers by digestion with a solvent mixture at least four times the weight of the lignocellulose to be pulped, with the solvent made up of methanol:water in the proportion 1:1 to 4:1 and substantially anhydrous merely having water which was contained in the lignocellulose and containing from 0.001 to 1.0 moles per liter of a metal salt which is a chloride or nitrate of magnesium, calcium, and barium, and mixtures thereof, or is magnesium sulphate, with even seawater being effective as a source of catalyst, at 170° to 240° C. for a time generally from a few minutes to 90 minutes at pressures normally those generated from the heated solvent in closed vessels, corresponding to the laws of thermodynamics, or particularly at higher than normal pressures generated and maintained by any means during the cooking process. The pressure is preferably between 15 and 48 atmospheres; however, pressures as high as 300 λP, atmospheres can be used to increase the selectivity in delignification of the chips of lignocellulosic material.

The preferred use of high process pressures allows virtually all the lignin and only a minimum of the cell wall carbohydrate materials to be removed within relatively short cooking times. Fiber yields almost equal to the total cellulose content and a substantial proportion of the hemicellulose content originally present in the wood, can be obtained. As will be made evident in the disclosure, the pressure is not applied as a means of furthering liquor penetration as was earlier thought to be required in the prior art (Dreyfus U.S. patent Ser. No. 2,022,654 and Kleinert W. German Patent application Ser. No. 26 44 155, 1977) but is applied in order that the kinetics of carbohydrate degradation be favorably altered by furthering the selectivity of delignification in this process.

No degradation other than depolymerization of the dissolved lignins and carbohydrates occurs during the high temperature cooking so that these can be substantially quantitatively recovered on reclaiming the cooking solvent. The pulp produced is low in residual lignin content and bright in color so that bleach requirement to attain a certain brightness is much reduced. The process uses a solvent combination which is inexpensive, low in specific heat in minimum quantities dictated only by the void volume inside the lignocellulose and around the packed chips to be filled. Thus the process maximizes on fiber yield and quality, mass recovery per unit weight of lignocellulose pulped and minimizes on energy required for obtaining fully liberated fibers for papermaking and dissolving pulp purposes. The process is particularly efficient in making fibers of extremely high viscosity at high fiber yields. The spent cooking liquor is stable against lignin precipitation even after cooling to room temperature whereby pulp washing and disintegration can be done in the cooking liquor to remove trapped dissolved lignins. The combination of high alcohol concentration and high process pressures allows protection of the carbohydrates and production of pulps with superior high viscosity.

The primary catalytic system can be extended to numerous added acidic compounds as secondary catalysts which are in addition to those autocatalytically generated during the high temperature cooking procedure. The use of acidic compounds are particularly advantageous at the pressures used during the cooking which produces totally liberated fibers of very high viscosity and low Kappa number without requiring mechanical refining or grinding. The pulps also have nearly theoretical alpha-cellulose content and retain a high proportion of the hemicelluloses required for forming strong paper webs. With these embodiments of the invention, the process becomes universally effective in treating both gymonsperm and angiosperm woody materials as well as lignocellulosic plant materials such as bamboo, sugarcane, cereal and grass plant stalks.

A surprising synergistic effect has been observed between the primary and secondary catalyst combinations at individual concentrations otherwise largely ineffective unless combined as indicated herein. This effect becomes quite striking when levels of minimum effective catalyst concentrations claimed in our previous Canadian No. 316,951 application are compared to those now also found effective and described in the ensuing examples, particularly Table 5. For instance, earlier for delignification of spruce wood the minimum effective primary catalyst concentration was stated as 0.005 Molar with the preferred concentration being 0.025 to 0.05 Molar. In contrast we have found that when an auxiliary secondary catalyst as indicated in Table 1 is added and used with any of the primary catalysts, the primary catalyst concentration can also be lowered to levels (e.g., 0.003 Molar and less) where it was previously deemed ineffective. In addition, it is also discovered that concentration of the secondary catalyst can also be lowered to levels where the otherwise, in comparison to the primary catalysts, aggressive and strong acids would be largely ineffective and would not lead to fiber separation without excessively long cooking times or high temperatures.

The trace amount of an acidic compound employed as a secondary catalyst is preferably one of the strong mineral acids sulphuric, hydrochloric and nitric, but in no case should exceed 10% of the weight of the primary salt catalyst. An effective concentration of secondary acidic compound catalyst in the cooking mixture can be as low as 0.0001 Normal, where it is found the lignocellulosic material resists delignification and fiber separation is delayed. Particularly resistive materials may benefit by increasing acid concentration to about 0.002 Normal to 0.008 Normal (but not exceeding 0.01 Normal) since the delignification rate is increased by use of combined primary and secondary catalytic agents.

For lignocellulosics which may show particular resistance to delignification even in the presence of the alkali earth metal catalyst, incorporation of a strongly acidic compound in addition to organic acids autocatalytically generated during the cooking process, in amounts between 0.01 Normal or Molar is preferred. For less resistant lignocelluloses, weaker mineral acids such as boric, sulphurous or phosphorous acids or other acids with $P_k$ values below about 4.0; organic acids such as oxalic, maleic and salicilic acids or those acids having $P_k$ values below about 4.75 or acid salts such as aluminum chloride or sulphate, ferric or ferrous chloride, or stannic chloride can be used. The acidic salts are preferably used in an amount between a trace and 0.025 Molar. A more complete list of the acidic compounds of our invention is set forth in Table 1. In each instance the salt should be relatively non-toxic or it should be removed upon completion of the cooking so as to not cause a pollution problem.

TABLE 1

| Strong Mineral Acids | Weak Mineral Acids | Organic Acids | Acidic Salts* |
|---|---|---|---|
| $HClO_4$; HI; HBr; HF; HCl; $H_2SO_4$; $H_3PO_4$; $HNO_3$ | $HSO_3$—; $H_3PO_3$; etc, $P_k$ below 4.0 | Formic; Acetic; Levulinic; Oxalic Maleic Salicylic; Succinic Nicotinic; o-Phthalic $F_3$ or $Cl_3$—acetic; Toluensulfonic; Benzoic etc. $P_k$ below 4.75 | $Al^{+++}$; $Fe^{+++}$; $Cu^{++}$; $Cd^{++}$; $Co^{+++}$; $Cr^{++}$; $Cr^{+++}$; $Be^{++}$; $Bi^{++}$; $Ga^{+++}$; $Tl^{+}$; $Tl^{+++}$ $Sn^{++}$; $Sn^{++++}$ $Mn^{++}$ |

*including various acidic anions.

The use of an added secondary acidic compound hydrolyzing catalyst is optional and serves the function to accelerate the splitting of lignin carbohydrate bonds during the process of delignification. It is particularly important that when secondary catalysts are used the effective concentrations of both the primary and auxiliary catalyst can be substantially reduced to levels at which none of the individual catalysts would be effective alone.

The preferred alcohol is methanol in aqueous mixture of alcohol-water volume ratio ranging from nearly equal moles, e.g. 70 volumes of methanol to 30 volumes of water, but preferably higher alcohol-water ratios should be used, for example 95 volumes of methanol to 5 volumes of water, and even higher ratios are effective for rapid delignification. Ethanol is the preferred alternate solvent for countries where methanol is not available from domestic synthetic or natural sources. At the highest ratios it is necessary to calculate the amount of water contributed by the moisture content of lignocellulosic material such as wood chips, and to proportion the mixture using anhydrous alcohol stock.

At high alcohol-water ratios not only is delignification more complete, but carbohydrate degradation is suppressed, especially if also high pressure is used during the cooking cycle, and the resulting aqueous solution will have improved dissolving power for the lignin. Upon evaporation of the cooking solvent an aqueous solution of sugars is obtained which will have solids in excess of 8 percent and up to 25 percent. Such high sugar concentrations are especially advantageous in further processing of the sugars (fermentation) and concentration of the fermentation effluents to eliminate pollution. Further, less water needs to be heated for distillation for stripping of the alcohol during the recovery process.

The process is effective to delignify lignocellulosic materials rapidly, achieving yields of free-fiber cooked material as high as 80% of wood weight, when the salt is magnesium or calcium chloride or nitrate or magnesium sulfate at a concentration between 0.002 to 0.1 moles per liter of cooking mixtures and the solvents comprise methanol-water in at least equimolar ratio, and preferably 2:1 molar ratio or greater. Such solvent mixture may be proportioned in the range 70:30 to 95:5, preferably 90:10 to 95:5, volume ratio of alcohol to water. Particularly high yields of separated fibers with very good fiber properties can be obtained when cooking times are short by selecting high cooking temperatures between 180° C. to 230° C. and preferably ranging from 210° C. to 225° C. or higher, excluding any secondary catalyst acidic compound.

The process exhibits a high tolerance to large variation in the molar concentration of the calcium, magnesium or barium salt used, assuming that other parameters such as time, solvent composition and temperature are held constant. Hardwoods may generally be cooked with lower salt concentrations ranging from about 0.01 moles per liter to 0.10 moles per liter to free-fiber condition with calcium or magnesium chloride or nitrate at 170° C. in from 10 minutes to 50 minutes. Softwoods such as Spruce will usually require salt concentrations between 0.025 moles per liter to 0.20 moles per liter. Difficult to delignify species may require concentrations as high as 0.5 molar where no acidic compound secondary catalyst is used.

In considering whether a given material should be cooked with salt catalyst alone, or augmented by addition of trace amount of secondary acid catalytic agent, the practice of the invention will necessarily require some experimentation to obtain maximum pulp properties. Each lignocellulosic material presents a different composition and character of its lignin-carbohydrate matrix, cell wall porosity, sequestered mineral quantity and composition, and gums, waxes and other extractives. The cooking of wheat straw, for example, has been found to require addition of at least enough mineral acid to make the cooking mixture 0.002 Normal with respect to an acid such as hydrochloric to satisfy reactions with occluded substances. Certain woods due to their growing conditions may similarly require threshold quantities of acid catalyst before the required level of hydrogen ion or proton concentration is attained. A controlled level of acidic pH can also be set up by buffering whereby, the buffering can be readily achieved by the formation of base metal ion-weak acid salts. Such control automatically assures highest delignification specificity.

It is to be understood that when cooking softwoods the use of combined magnesium, calcium or barium salt and a secondary acid catalyst will usually result in an increased pulp yield at a given Kappa number end point at free-fiber cooked condition. It is also to be expected that the total cooking time is shortened by using combined catalytic agents rather than primary catalyst salt alone, with the consequence that the viscosity of the fibers will be higher, and lower cooking temperatures will be effective.

Throughout this specification all viscosity evaluations are reported in accordance with testing procedures specified in TAPPI standards T230 su-66; values are reported in centipoise under the heading "TAPPI 0.5% CuEn".

Apart from considerations of process advantages when using combined primary and secondary catalytic agents, such as lower cooking temperatures, shortened cooking times for satisfactory pulp yields at a given Kappa number, corrosion problems attending use of as little as 0.001 Normal acid in solution may compel use of primary salt catalyst alone. In cooking with the primary catalyst salt only, the salt preferably should be calcium or magnesium chloride or nitrate or mixtures thereof, in a solvent mixture of the highest alcohol-water ratios practicable, for example 95:5 methanol-water. Such cooking solvent mixture is highly specific to removal of lignin, so that yields of almost the theoretical amount of undegraded holocellulose can be realized. As will be made evident from the Examples and data presented in the pages following, a high yield of free-fiber pulp at an acceptable residual lignin content is obtained by such cooks. While it has been found that at higher alcohol-water ratios there is a retarding effect on fiber liberation, this can be readily offset by cooking at higher temperatures than have been proposed or thought feasible heretofore in organosolv pulping processes, noteably at temperatures in the extraordinarily high range 210° C. to 240° C.

It has been found that both pulp yield and pulp quality are greatly improved by cooking in the range 170° C. to 220° C. when the alcohol is methanol and the solvent mixture is at an alcohol-water ratio at least 80:20 or even 98:2. The selectivity of delignification is found to be improved so that fiber-free pulps at high yield with acceptable lignin content are obtained, and the fiber viscosity is exceptionally high, surpassing that measured for conventional Kraft pulps. These fibers also contain close to theoretical amounts of carbohydrate especially alpha cellulose. Nevertheless, despite the high temperature to which solubilized lignin is subjected in the cooking vessel, condensation problems, contamination of fiber, scaling of vessel walls, and darkening and recondensation and reprecipitation on cooked fibers of lignin do not arise. It can therefore be concluded that such acid-free solvent mixtures using very high alcohol-water ratios at very elevated temperatures and neutral or acidified calcium or magnesium salt catalysts represent a remarkable advance in organosolv cooking methods.

In case the digester void volume is reduced to less than the normal expansion of the cooking chemicals plus the chip charge, high pressures are provided inside the digester with the benefit of reduced cooking time and higher selectivity to delignification with virtually no degradation of the native cellulose. Other means of generating these excess pressures such as from compressed non-reactive gases, pressure intensifiers, vibrators are equally effective. When an acidic compound secondary catalyst is also used, the cooking temperature can be lowered but the alcohol concentration is kept as high as possible.

The invention will be more particularly revealed in and by the Examples and Tables of data reported from experimental cooks according to the invention discussed hereinafter.

EXAMPLE 1

To investigate the effectiveness of delignification and yield of fiber when using the novel salt-catalyzed methanol-water solvent mixtures of the invention, a number of cooks were carried out in a laboratory scale stainless steel pressure vessel having internal chamber height 11 cm and diameter 4.5 cm (175 $cm^3$).

Wood chips in both air-dry and green condition were brought to uniform moisture content prior to cooking. Batch quantities of wood chips amounting to between 5 g and 20 g of actual wood weight were placed in the digester and between 100 g and 120 g of prepared solvent mixture was added, predetermined quantities of primary and/or secondary catalyst compounds having been previously dissolved therein. The ratio of wood weight to solvent mixture weight ranged from 1:6 to 1:10. The volume ratio of methanol to water, including moisture contained in the wood, ranged between 70:30 to 98:2. The void volume of the chamber was about 15 to 20 $cm^3$. The lowest pressure produced was about 15 atmospheres at 170° C. for a 70:30 alcohol-water mixture. The highest pressure was above 40 to 48 atmospheres for virtually anhydrous alcohol at temperatures between 200° and 220° C.

The sealed stationary vessel was heated without liquor circulation by placing it in a thermostatically controlled hot glycerine bath. The vessel temperature was brought up to the desired elevated temperature within 11 minutes, after which the temperature was held constant for the cooking interval required.

The reported cooks are those which at the end of the stated cooking time entered in the TABLES 2, 3 and 4 produced a pulp which was in the form of free fibers after the cellulosic residue had been removed from the vessel and slurried in 500 ml of acetone with stirring using a laboratory disintegrator rotating at less than 800 RPM.

At the end of each cook the vessel was chilled and the liquor decanted. The drained pulp was washed first with acetone, then water-washed, and the cleansed pulp was air-dried until constant weight was obtained. Samples were reserved for Kappa number and viscosity determinations where applicable, and the remaining cellulosic residue was analyzed for final moisture content to allow calculation of the pulp yield. For all analyses TAPPI standard test procedures were used.

The fully cooked chips were found to be readily separable into free fibers on slushing in acetone which removed the greater part of the solubilized lignin trapped within the cooked chips and fibers. Some of the fiber residues were washed first with hot or with cold catalyst-free solvent mixture; it was found that subsequent washing with water had no adverse effect on bleachability of the fibers and removed only a minor amount of color.

TABLES 2, 3, and 4 indicate determinations made on the prepared pulps. Spruce, which is representative of the coniferous species known to be difficult to delignify by prior art aqueous alcohol cooking methods, is shown to be well delignified by cooking with either salt catalyst alone or with combined salt and acid catalyst compounds, and to yield pulps retaining major percentages of hemicelluloses.

A low residual lignin content is easily reached in relatively short cooks and the degree of polymerization of the fiber material is higher than that observed in most pulps produced by the Kraft process. At total cooking times of 20 to 40 minutes, pulps were obtained with a Kappa number of 33, and a TAPPI (0.5%) viscosity of 20 to 48 centipoise corresponding to a degree of polymerization ranging from 1320 to 1880 (Rydholm, "Pulping Processes", p. 1120). The Kappa number divided by seven to 7.7 depending upon the species is equal to the weight percent of lignin in the pulp recovered. The cooked chips when slurried into water showed an as-cooked brightness of 52 to 55% GE. Kraft cooks of spruce at comparable residual lignin content typically have a brightness under 35. Aspen pulps made by the process of the present invention have as-cooked brightness between 60 and 70 GE.

Pulping of Spruce wood in short cooks made with the higher alcohol-water ratios, namely at 80:20 volume ratio upward to 95:5, and at constant salt concentration of 0.05 moles per liter excluding any addition of acid, showed that in spite of high Kappa number, somewhat above 60, complete fiber separation had been attained at the end of short cooking (under about 35 minutes). The pulps made were relatively bright in their unbleached state, and amounted to exceptionally high weight percentage of the wood.

Several of the higher-yielding cook residues were further delignified with sodium chlorite-for 5 minutes according to TAPPI test procedure T 230-su-66 in preparation for further purification to an alpha-cellulose according to TAPPI T 429-m-48 (gravimetric) method to estimate the 17.5% NaOH-resistant fraction of the pulps. Spruce pulps averaged between 43.8 to 45.1% based on dessicated wood weight as 100, this figure showing little variation with actual pulp yield. The TAPPI 0.5% CuEn viscosity (TAPPI T 230 os-76) determined on the alpha-cellulose was between 35 and 54 centipoises.

Aspen pulps showed in comparable tests an alpha-cellulose of 48%.

TABLE 2

PULP PROPERTIES OF SPRUCE WOOD COOKED IN METHANOL-$H_2O$ (70:30) at 200° C. WOOD/LIQUOR RATIO 1:10 WITH VARIOUS SALT AND/OR ACID CATALYZING AGENTS

| CATALYST | | | | COOKING TIME* | PULP YIELD WT. % WOOD | KAPPA | TAPPI (0.5%) VISCOSITY | DEGREE OF POLY- | |
|---|---|---|---|---|---|---|---|---|---|
| Acid | Normal | Salt | Molar | min | COOKED | NO. | cP | MERIZATION | SPECIES |
| $H_2SO_4$ | 0.0038 | — | — | 40 | 46 | 39 | 3.7 | 460 | SPRUCE |
| — | — | $MgSO_4$ | 0.05 | 60 | 78 | 105 | Poor Fiber separation | | WOOD |
| | 0.0038 | | 0.05 | 40 | 51 | 36 | 9.5 | 910 | |
| HCl | 0.0025 | — | — | 40 | 70 | — | No Fiber Separation | | SPRUCE |
| — | — | $CaCl_2$ | 0.05 | 40 | 54 | 44 | 20 | 1320 | WOOD |
| | 0.0025 | | 0.05 | 40 | 56 | 28 | 19 | 1310 | |
| | 0.0025 | | 0.05 | 35 | 56 | 40 | 23 | 1420 | |
| | 0.0025 | | 0.05 | 30 | 56 | 50 | 28 | 1550 | |
| | 0.0025 | | 0.05 | 20 | 59 | 65 | 22 | 1600 | |
| | 0.0040 | | 0.05 | 40 | 53 | 37 | 23 | 1420 | |
| $HNO_3$ | 0.004 | — | — | 45 | 48 | 50 | 4 | 470 | SPRUCE |
| — | — | $Ca(NO_3)_2$ | 0.10 | 45 | 58 | 62 | 29 | 1570 | WOOD |
| | 0.004 | | 0.10 | 45 | 55 | 37 | 23 | 1420 | |
| | — | $Mg(NO_3)_2$ | 0.10 | 45 | 57 | 55 | 23 | 1420 | |

TABLE 2-continued

PULP PROPERTIES OF SPRUCE WOOD COOKED IN METHANOL-$H_2O$ (70:30) at 200° C. WOOD/LIQUOR RATIO 1:10 WITH VARIOUS SALT AND/OR ACID CATALYZING AGENTS

| CATALYST | | | | COOKING TIME* | PULP YIELD WT. % WOOD | KAPPA | TAPPI (0.5%) VISCOSITY | DEGREE OF POLY- | |
|---|---|---|---|---|---|---|---|---|---|
| Acid | Normal | Salt | Molar | min | COOKED | NO. | cP | MERIZATION | SPECIES |
| | 0.002 | | 0.10 | 45 | 56 | 39 | 25 | 1450 | |
| HCl | 0.002 | — | — | 30 | 75 | — | No Fiber Separation | | ASPEN |
| | 0.002 | $CaCl_2$ | 0.05 | 25 | 58 | 20 | 25 | 1450 | WOOD |
| HCl | 0.01 | $CaCl_2$ | 0.05 | 25 | 58 | 22 | 26 | 1480 | WHEAT STRAW |

*Includes heating up time of 11 minutes.

TABLE 3

AQUEOUS METHANOL COOKING WITH METAL SALT CATALYSTS METHANOL-WATER RATIO 70:30 WOOD/LIQUOR 1:10

| WOOD SPECIES | SALT | MOLES PER L. | COOKING TIME Min.* | COOKING TEMP. °C. | PULP YIELD WT % | KAPPA NO. | TAPPI 0.5%-Visc. cP | DP |
|---|---|---|---|---|---|---|---|---|
| ASPEN WOOD | $MgCl_2$ | 0.01 | 30 | 200 | 62 | 27 | 20 | 1320 |
| | " | 0.01 | 25 | 200 | 59 | 15 | 19 | 1400 |
| | $MgSO_4$ | 0.05 | 60 | 200 | 64 | 35 | 23 | 1410 |
| | $CaCl_2$ | 0.01 | 30 | 200 | 63 | 30 | 21 | 1360 |
| | " | 0.025 | 35 | 190 | 71 | 46 | 32 | 1600 |
| | " | 0.1 | 15 | 200 | 90 | 99 | No Fiber Separation | |
| | " | 0.1 | 25 | 200 | 63 | 22 | 21 | 1360 |
| | " | 0.1 | 30 | 190 | 61 | 25 | 24 | 1440 |
| | " | 0.1 | 30 | 200 | 73 | 61 | 24 | 1450 |
| | " | 0.1 | 40 | 190 | 57 | 9 | 21 | 1360 |
| SPRUCE WOOD | $BaCl_2$ | 0.05 | 30 | 200 | 69 | 46 | Poor Fiber Sep'n | |
| | $MgCl_2$ | 0.05 | 30 | 200 | 59 | 51 | 17 | 1200 |
| | " | 0.10 | 30 | 200 | 54 | 29 | 18 | 1270 |
| | $MgSO_4$ | 0.05 | 60 | 200 | 78 | 95 | Poor Fiber Sep'n | |
| | $Mg(NO_3)_2$ | 0.10 | 45 | 200 | 57 | 53 | 23 | 1410 |
| | $Ca(NO_3)_2$ | 0.10 | 45 | 200 | 58 | 62 | 29 | 1570 |
| | $CaCl_2$ | 0.05 | 30 | 200 | 66 | 60 | 28 | 1500 |
| | " | 0.10 | 20 | 200 | 72 | 103 | Poor Fiber sep'n | |
| | " | 0.10 | 30 | 200 | 62 | 63 | 24 | 1440 |
| | " | 0.10 | 40 | 200 | 56 | 46 | 18 | 1275 |
| | " | 0.10 | 50 | 200 | 52 | 42 | 15 | 1160 |
| | " | 0.10 | 55 | 190 | 63 | 61 | 28 | 1500 |
| | " | 0.10 | 85 | 190 | 56 | 40 | 23 | 1410 |

*Includes heating-up time of 11 minutes.

TABLE 4

VARIATION OF METHANOL-WATER RATIO, COOKING TEMPERATURE, AND TIME IN $CaCl_2$-CATALYZED (0.05 MOLES PER L) PULPING OF ASPEN AND SPRUCE WOODS

| SPECIES | ALCOHOL TO WATER RATIO* | COOKING TEMP °C. | COOKING TIME min. | PULP YIELD % | PULP KAPPA No | TAPPI 0.05% CuEn VISCOSITY, cp. |
|---|---|---|---|---|---|---|
| ASPEN WOOD | 70:3- | 190 | 30 | 61 | 25 | 24 |
| | 80:20 | 190 | 42 | 61 | 14 | 32 |
| | 90:10 | 190 | 35 | 64 | 20 | 50 |
| | 90:10 | 190 | 50 | 63 | 15 | 38 |
| | 95:5 | 190 | 30 | 67 | 39 | 44 |
| | ANHYDR. | 190 | 50 | 69 | 37 | 42 |
| | 90:10 | 200 | 10 | 61 | 19 | 36 |
| | 95:5 | 220 | 8.5 | 66 | 33 | 40 |
| SPRUCE WOOD | 70:30 | 200 | 30 | 56 | 47 | 23 |
| | 80:20 | 200 | 50 | 59 | 45 | — |
| | 80:20 | 210 | 13 | 70 | 95 | 46 |
| | 80:20 | 210 | 25 | 60 | 42 | 37 |
| | 90:10 | 210 | 20 | 75 | 86 | 48 |
| | 90:10 | 210 | 25 | 69 | 70 | — |
| | 90:10 | 220 | 11 | 78 | 112 | — |
| | 90:10 | 220 | 13 | 74 | 99 | — |
| | 90:10 | 220 | 20 | 61 | 59 | 40 |
| | 90:10 | 220 | 25 | 59 | 39 | 43 |
| | 95:5 | 200 | 50 | 66 | 75 | 46 |
| | 95:5 | 200 | 55 | 63 | 59 | 42 |
| | 95:5 | 220 | 15 | 66 | 60 | 42 |
| | 98:2 | 220 | 35 | 63 | 52 | 35 |

*Wood/Liquor ratio 1:10

**Cooking time includes 11 minute heating-up time.

TABLE 5 shows the effect of added strong mineral acid secondary catalysts on delignification of spruce wood whereas in TABLE 4 the effect of varying alcohol-water ratios and the compensating effect of increased temperature and prolonged cooking time was demonstrated. Pulping spruce wood at the high alcohol concentrations indicated in the table shows that in the presence of 0.05 molar salt concentrations, with or without the secondary acid catalysts, free fiber separation is obtained within 15 to 60 min and in spite of the relatively high Kappa number, fiber liberation was obtained at relatively high pulp yield. The pulps had viscosities between 20 to 48 centipoise corresponding to a degree of polymerization of 1320 to 1880 (Rydholm, Pulping Processes, p. 1120).

In a number of cooks (not reported) wherein the length of the cooking interval was insufficient to allow total fiber liberation, it was found that vigorous agitation in a high speed blender rotating at 3000 RPM was effective to free the pulp fibers. In certain of the reported cooks where "poor fiber separation" is indicated, the cooked material could also be converted to a high yield free pulp by mechanical working. It is therefore to be understood that the invention is not limited to a length of cooking at which the free fiber state is reached in cooked plant materials within the digester and manifested by simple stirring, but extends to cooking for only a sufficient time to achieve minimal delignification and hemicellulose removal such as will yield up to 90% of the original weight of lignocellulose as pulp product.

TABLE 5

COOKING SPRUCE WOOD WITH PRIMARY AND AUXILIARY ACID HYDROLYZING CATALYSTS

| CATALYST Secondary NORMAL/MOLAR | CATALYST Primary NORMAL/MOLAR | COOKING TIME* min | COOKING TEMP. °C. | PULP YIELD % | KAPPA NO. | TAPPI 0.5% VISCOSITY cP |
|---|---|---|---|---|---|---|
| $H_2SO_4$ 0.0038 | | 40 | 200 | 46 | 39 | 3.7 |
| | $MgCl_2$ 0.01 | 50 | 200 | No Fiber Separation | | |
| $H_2SO_4$ 0.001 | $MgCl_2$ 0.0038 | 35 | 200 | 58 | 38 | 19 |
| | $CaCl_2$ 0.01 | 45 | 200 | No Fiber Separation | | |
| $SnCl_2$ 0.002 | $CaCl_2$ 0.01 | 55 | 200 | 63 | 77 | 22 |
| | | 40 | 200 | 58 | 67 | 24 |
| $AlCl_3$ 0.005 | | 70 | 200 | No Fiber Separation | | |
| $AlCl_3$ 0.0003 | $CaCl_2$ 0.01 | 40 | 200 | 60 | 67 | 24 |
| | | — | — | — | — | — |
| $H_2SO_3$ 0.005 | | 70 | 200 | No Fiber Separation | | |
| $H_2SO_3$ 0.009 | $CaCl_2$ 0.003 | 65 | 200 | 67 | 93 | 22 |
| | | — | — | — | — | — |
| HCl 0.0025 | | 40 | 200 | No Fiber Separation | | |
| HCl 0.002 | $CaCl_2$ 0.025 | 45 | 200 | 59 | 56 | 27 |
| | | — | — | — | — | — |
| SALICYLIC ACID 0.005 | | 70 | 200 | No Fiber Separation | | |
| SALICYLIC ACID 0.001 | $MgCl_2$ 0.005 | 55 | 200 | 62 | 60 | 28 |
| | | — | | | | |
| OXALIC ACID 0.005 | | 70 | 200 | No Fiber Separation | | |
| OXALIC ACID 0.0001 | $CaCl_2$ 0.005 | 65 | 200 | 61 | 78 | 27 |
| | | 85 | 200 | 58 | 67 | 26 |
| | | 55 | 210 | 63 | 57 | 30 |
| ACETIC ACID 0.005 | | 70 | 200 | No Fiber Separation | | |
| ACETIC ACID 0.001 | $CaCl_2$ 0.005 | 55 | 200 | 61 | 68 | 34 |
| | | — | | | | |

*Includes 11 min heating-up time to temperature

The process is also highly tolerant to cooking time in that even substantially prolonged cooks, for instance of durations 50 to 60 minutes, produce pulp yields in excess of 54% wherein the parameter most affected is residual lignin, which tends to be reduced as evidenced by lowered Kappa number.

Numerous other acidic compound secondary catalysts were also tested but their results not reported herein due to the large similarity in results obtainable on applying them. In these cases some adjustments in cooking conditions were necessary to compensate for the variation in acid strength.

EXAMPLE 2

In a further series of cooks carried out as for EXAMPLE 1, all of these with the exception of wheat straw employed only calcium chloride as primary catalyst. HCl is necessary when cooking wheat straw as evidenced by the low residual lignin achieved.

The pulp properties are set out in TABLE 6. The pulp fibers prepared by the cooks were first screened through a No. 6 cut screen, and then beaten to 300 ml Csf (Canadian Standard Freeness, TAPPI T 227 Os-58)

in a PFI mill and standard handsheets were prepared according to relevant TAPPI standard procedures. The sheets were conditioned overnight at 50% relative humidity and 21° C., and tested for breaking length, burst, tear and zero-span, also according to relevant TAPPI standards. The strength data obtained on these pulps is set out in TABLE 7.

It can be seen from the data that the intrinsic fiber strength values surpass any known heretofore in organosolv cooking, and that the overall strength values, especially of those pulps made with high alcohol-water ratios, closely approximate values reported in the literature for the species tested.

Comparative summative analyses for sugars and lignin were carried out on the original wood, on the isolated pulp and on the residual liquors from Aspen and Spruce cooks. The procedure for obtaining test samples conformed with that set out in Example 1. The findings of these investigations are summarized in Table 8.

TABLE 6

PULPING OF VARIOUS LIGNOCELLULOSE SPECIES WITH $CaCl_2$-CATALYZED ALCOHOL:WATER MIXTURES

| COOK No. | SPECIES | $CaCl_2$ Moles per L. | ALCOHOL/ WATER RATIO | COOKING TEMP °C. | COOKING TIME* min | PULP YIELD % | PULP KAPPA NO. | TAPPI 0.5% CuEn VISCOS. cP | CATIONS IN WOOD $Ca^{++}$ | CATIONS IN WOOD $Mg^{++}$ | CATIONS IN PULP $Ca^{++}$ | CATIONS IN PULP $Mg^{-+}$ |
|---|---|---|---|---|---|---|---|---|---|---|---|---|
| 1 | ASPEN | 0.025 | 70:30 | 190 | 35 | 71 | 46 | 32 | | | | |
| 2 | WOOD | 0.05 | 70:30 | 190 | 30 | 61 | 25 | 24 | | | | |
| 3 | | 0.10 | 70:30 | 190 | 40 | 57 | 9 | 21 | 0.022 | 0.109 | 0.011 | 0.001 |
| 4 | | 0.05 | 90:10 | 190 | 35 | 63 | 26 | 50 | | | | |
| 5 | | 0.05 | 95:5 | 190 | 50 | 61 | 15 | 37 | | | | |
| 6 | SUGARCANE | 0.05 | 70:30 | 190 | 30 | 58 | 12 | 23 | | | | |
| 7 | WHEAT STRAW | 0.05** | 70:30 | 200 | 25 | 58 | 22 | 26 | | | | |
| 8 | BIRCH WOOD | 0.10 | 70:30 | 190 | 40 | 56 | 20 | 21 | 0.015 | 0.071 | 0.002 | 0.015 |
| 9 | SPRUCE | 0.025 | 90:10 | 220 | 30 | 58 | 40 | 42 | | | | |
| 10 | WOOD | 0.05 | 90:10 | 220 | 25 | 58 | 40 | 48 | | | | |
| 11 | | 0.10 | 90:10 | 220 | 20 | 54 | 27 | 30 | | | | |
| 12 | | 0.10 | 70:30 | 200 | 30 | 54 | 35 | 19 | 0.005 | 0.065 | 0.008 | 0.001 |
| 13 | | 0.05 | 90:10 | 210 | 50 | 59 | 47 | 42 | | | | |
| 14 | | 0.05 | 95:5 | 220 | 20 | 65 | 58 | 38 | | | | |
| 15 | | 0.05 | 95:5 | 220 | 15 | 71 | 75 | 38 | | | | |
| 16 | W. | 0.05 | 95:5 | 220 | 15 | 61 | 74 | 32 | | | | |
| 17 | HEMLOCK | 0.05 | 70:30 | 200 | 30 | 59 | 30 | 21 | | | | |
| 18 | W. RED CEDAR | 0.05 | 70:30 | 200 | 35 | 52 | 41 | 22 | | | | |
| 19 | DOUGLAS-FIR | 0.10 | 70:30 | 200 | 30 | 54 | 35 | 21 | | | | |
| 20 | PONDEROSA | 0.05 | 90:10 | 220 | 11 | 67 | 65 | 45 | | | | |
| 21 | PINE | 0.05 | 90:10 | 220 | 25 | 54 | 26 | 37 | | | | |

*Includes 11 minutes heating-up time;
**solvent mixture contains 0.01 Normal HCl, cook #7 only.

TABLE 7

HANDSHEET PROPERTIES OF WASHED, UNBLEACHED PULPS BEATEN TO 300 ml Csf IN PFI MILL.

| SPECIES OF LIGNOCELLULOSE | ORIGINAL PULP FREENESS Ml, CsF | BEATER REVS. | BREAKING LENGTH, m | TEAR FACTOR | BURST FACTOR | ZERO SPAN m | COOK NUMBER* |
|---|---|---|---|---|---|---|---|
| ASPEN | 715 | 2300 | 8800 | 73 | 65 | 13850 | 3 |
| WOOD | 690 | 2400 | 10800 | 72 | 54 | 15900 | 4 |
| | 660 | 2000 | 10790 | 63 | 53 | 13720 | 5 |
| SUGARCANE RIND | 500 | 1300 | 8100 | 66 | 61 | 13000 | 6 |
| WHEAT STRAW | 478 | 1100 | 11000 | 82 | 68 | 15200 | 7 |
| BIRCH WOOD | 680 | 1800 | 9500 | 71 | 71 | 13900 | 8 |
| SPRUCE | 750 | 4000 | 10800 | 91 | 76 | 14900 | 12 |
| WOOD | 710 | 2000 | 11500 | 79 | 80 | 13800 | 13 |
| | 720 | 3500 | 12100 | 88 | 81 | 13900 | 14 |
| | 710 | 4500 | 11900 | 80 | 79 | 14870 | 15 |
| WESTERN | 700 | 3500 | 12200 | 112 | 76 | 15600 | 16 |
| HEMLOCK | 720 | 2300 | 11500 | 114 | 72 | 15900 | 17 |
| DOUGLAS-FIR | 710 | 1800 | 9580 | 91 | 52 | 14200 | 18 |

*Cook Number refers to cooks in TABLE 5.

TABLE 8

COMPOSITION OF WOOD, COOKED PULP AND COOKING LIQUOR.

| SPECIES | SUBSTRATE ANALYZED | PULP YIELD % | RESID. LIGNIN % | TAPPI (0.5%) VISC. cP | CARBOHYDRATES GLUC. % | XYL. % | GAL. % | ARAB. % | MANN. % | GALAC. % | TOTAL SUGARS % |
|---|---|---|---|---|---|---|---|---|---|---|---|
| ASPEN WOOD | WOOD | 77.4[1] | 19.7[2] | 22[3] | 57.9 | 13 | 0.5 | 0.2 | 3.4 | 1.0 | 76.0 |
| | PULP | 61.0 | 2.1 | 19 | 53.1 | 3 | 0.1 | trace | 2.2 | 0.1 | 58.26 |
| | LIQUOR | — | 16.3 | — | 0.4 | 7 | 0.5 | trace | 0.8 | 0.2 | 9.1 |

TABLE 8-continued

COMPOSITION OF WOOD, COOKED PULP AND COOKING LIQUOR.

| SPECIES | SUBSTRATE ANALYZED | PULP YIELD % | RESID. LIGNIN % | TAPPI (0.5%) VISC. cP | CARBOHYDRATES GLUC. % | XYL. % | GAL. % | ARAB. % | MANN. % | GALAC. % | TOTAL SUGARS % |
|---|---|---|---|---|---|---|---|---|---|---|---|
| SPRUCE WOOD | WOOD | 72.3 | 26.5 | 21 | 49.9 | 6 | 1.8 | 1.1 | 11.9 | 0.8 | 71.5 |
| | PULP | 52 | 2.9 | 19 | 43.1 | 2 | — | — | — | trace | 47.6 |
| | LIQUOR | — | 23.0 | — | 1.7 | 1.4 | 1.5 | 0.6 | 4.7 | 0.1 | 8.9 |

[1]Holocellulose (lignin-free);
[2]Klason lignin;
[3]FeTNa viscosity according to Jayme.

The work-up of liquors recovered from the digester consisted of evaporation of the volatiles at a temperature up to about 50° C. and low temperature (under 50° C.) precipitation of the lignin and water-insoluble substances. The precipitate was filtered, washed with water, and dried over $P_2O_5$ to give the water-insoluble lignin fraction, i.e. "precipitable lignin". This is a superior LP product which is a filterable solid which dries to a powder. Correction was made for substances other than lignin after redissolving the lignin in acetone and filtering the solution before re-precipitating into 15 volumes of water per volume of acetone. The residual aqueous sugar solution was acidified to make 3% acid with sulphuric acid and autoclaved for one hour at 105° C. to liberate the free sugars. The sugar solution was worked up to alditol acetates and the individual sugar concentrations determined by gas chromatography.

The recovered sugar solutions were found to be rich in xylose from Aspen cooks and in mannose from Spruce cooks, with other hemicelluloses including a minor quantity of glucose. The majority of the sugars occur as monomers and dimers, these amounting to about 70%, the remainder comprising low molecular weight oligomeric sugars. The latter can be readily converted to the monomeric form by secondary hydrolysis with 3% acid as described above.

Surprisingly, no furfurals were detected in residual liquors following any cooks using only salt catalyst compounds, whereas in prior organosolv cooking processes there is rapid conversion of pentosans to furfural and of glucose to levulinic acid, particularly at the higher cooking temperatures. Such products are formed by the dehydration reaction catalyzed by acids formed during the cooking, or by acids added as catalysts. When furfurals are formed in the cooking vessel they tend to condense with low molecular weight liquor fragments to form a product only poorly soluble in the cooking solvent mixture, hence objectionable scaling problems arise on cooling the liquor. The solid products tend also to block the micropores of chips during cooking, causing non-uniform cooking. In fact, the only solvent for the lignin-furfural condensation product is either tetrahydrofuran or dimethyl sulfonide.

The absence of furfural in the residual liquors produced after cooks using only the primary metal salt catalysts of this invention assures stability of the liquors which carry virtually all the lignin in solution even after cooling to room temperature, hence the cooked chips appear as though freshly scrubbed.

Another disadvantage of the presence of furfurals in sugar solutions arises when attempting to produce ethanol, butanol, acetone or other solvents by known enzymatic fermentation processes, or to produce yeast, the material being inhibitory.

The precipitated lignin, following removal of the volatiles from the liquor, retains its solvent solubility, which is a highly desirable property when chemical processing is contemplated. The molecular weight of such solvent-soluble lignin was determined by gel-permeation chromatography to fall between 90 to 12,000 with an average molecular weight calculated to be in the range of 1,200 to 2,800, depending on the length of cooking and catalyst concentration. Purification methods for this lignin include repeated reprecipitation into water or non-polar solvents such as diethyl ether, n-hexane, dichloro-ethylene and benzene; acetone, tetrahydrofuran, dimethyl sulphoxide, furfural, methyl cellosolve, dioxane, chloroform, acrylonitrile and ethanol have higher solubilities for the lignin.

The recovery of the filtered lignin from solution may most economically be done by spray-drying acetone solutions at temperature under 55° C. and under reduced pressure. The lignins obtained are of pale cream to tan color, and are in free-flowing powder form with marked capacity to retain electrostatic charge. The powder is easily handled when relative humidity is elevated.

Because the primary metal salt catalysts were suspected to enter into cation type exchange reactions with both the carbohydrates and lignin in wood during cooking, tests were made to determine if retained catalyst material contributed to the ash content of pulp, even after thorough washing. Some of the pulp samples obtained according to the method outlined in EXAMPLE 1 were subjected to digestion to strong oxidizing agent and the solution diluted with demineralized water. The diluted solution was then analyzed for $Ca^{++}$ and $Mg^{++}$ ions by absorption spectrophotometry. The data obtained is shown in TABLE 6, and surprisingly, shows the detected residual cation contents of the pulps to be much lower than in the original wood, indicating that some of the ash content is actually removed by the delignification process.

EXAMPLE 3

To determine the utility of free-fiber pulps made by the cooking process of the invention when subjected to a range of beating durations using a Jokro mill, chips from Spruce of European origin were cooked according to the method of EXAMPLE 1 and the pulp was tested according to appropriate DIN standards. Fresh chips at 54% moisture content were cooked in a methanol-water solvent mixture proportioned to take into account chip moisture to 70:30 volume ratio, catalyzed by 0.05 moles per liter of $CaCl_2$ and 0.002 Normal HCl, with wood/liquor ratio 1:10. A yield of 55% of wood weight was obtained, with Kappa number 45, and TAPPI 0.5% CuEn viscosity of 25 centipoise following 37 minutes cooking at 200° C., the time including 11 minutes warming-up to cooking temperature.

The cooked pulp was screened on a No. 6 cut screen and subjected to beating in a Jokro mill. At intervals enough slurry was withdrawn to form handsheets. The handsheets were conditioned at 75% relative humidity to a retained moisture content of 16.25% and strength determinations were then made on the high-moisture sheets. Strength values are listed in TABLE 9.

TABLE 9

STRENGTH VALUES OF EUROPEAN SPRUCE - BEATING VARIED

| Beating Time, min. | 0 | 15 | 30 | 45 | 60 | 75 |
|---|---|---|---|---|---|---|
| Freeness, SR | 15 | 22.5 | 43.5 | 61 | 74.5 | 82.5 |
| Basis Weight, g/m$^2$ | 76.5 | 77.7 | 77.0 | 78.0 | 77.8 | 79.1 |
| Breaking Length, meters | 5250 | 6250 | 7000 | 8300 | 9050 | 9050 |
| Tear cmg/cm | 152 | 137 | 121 | 108 | 99 | 99 |
| Elmendorf Tear, g | 380 | 361 | 357 | 344 | 344 | 333 |

EXAMPLE 4

In the prior art of alcohol-water cooking with lower aliphatic alcohols, very long cooking has been indicated to be necessary to delignify Spruce, for example. To evaluate the delignification extent and rate of alcohol-water cooks catalyzed by alkaline earth metal salts, a series of cooks with methanol, ethanol and n-propanol was carried out on Spruce using 0.16 molar $CaCl_2$ in 70:30 volume ratio alcohol-water mixtures, for times of about a half hour. The data is reported in TABLE 10. Methanol is clearly shown to be the alcohol of choice, in that isolated cellulosic residues have far higher viscosities.

TABLE 10

SOLVENT EFFECT ON $CaCl_2$ CATALYZED AQUEOUS ALCOHOL COOKING OF SPRUCE WOOD

| Alcohol | Alcohol/ Water Ratio | Catalyst Cooking Conc. Mols. | Time* Min | Temp. °C. | Pulp Yield % | Kappa No. | Tappi 0.5% CuEn Visc. cP |
|---|---|---|---|---|---|---|---|
| Methanol/ $H_2O$ | 80:20 | 0.16 | 30 | 200 | 58 | 63 | 18 |
| | 70:30 | 0.16 | 30 | 200 | 54 | 55 | 20.5 |
| | 60:40 | 0.16 | 30 | 200 | 51 | 44 | 14 |
| Ethanol/ $H_2O$ | 80:20 | 0.16 | 30 | 200 | 54 | 66 | 12.5 |
| | 70:30 | 0.16 | 30 | 200 | 50 | 59 | 8 |
| | 60:40 | 0.16 | 30 | 200 | 46 | 27 | 5 |
| N—Propanol/ $H_2O$ | 70:30 | 0.10 | 25 | 200 | 52 | 75 | 8 |
| | 70:30 | 0.10 | 35 | 200 | 48 | 48 | 6 |
| | 70:30 | 0.10 | 45 | 200 | 46 | 32 | 5 |

*Includes 11 minutes as heating-up time.

The pulping liquor when subjected to vacuum distillation at low temperature yields a flocculated lignin precipitate. After recovery of the lignin by filtration or centrifuging a sugar wort is obtained with solids concentration up to 25 percent of which 65 percent is dimeric and oligomeric sugars. Charcoal filtration removes most of the yellow color due to the water soluble lignin depolymerization products. The molecular weight distribution of the lignin shows one major and 2 to 3 minor peaks with the maximum being under 3800. Purification of the crude lignin is most effectively done by redissolution in acetone and spray drying in vacuum at low temperature to avoid melting and resinification. A dried solid filter cake is easily broken up into a free flowing tan-colored powder.

Very similar results were obtained with other lignocellulosic species whereby sugarcane rind behaved like aspen poplar, jack pine, ponderosa pine, western hemlock and Douglas-fir behaved like spruce wood whereas birch and Eucalyptus species proved to be intermediate species and wheat straw was found to be a more difficult species than spruce requiring larger catalyst concentrations than spruce to yield pulps with equal degree of delignification.

EXAMPLE 5

In a further series of cooks carried out as illustrated in EXAMPLE 1 the effect of degree of delignification was studied with respect to its influence on the pulp chemical, physical and mechanical properties. All cooks were conducted with $CaCl_2$ as the only catalyst and a standard liquor composition of 90:10 alcohol:water mixture containing 0.05 moles of catalyst was used throughout. The pulping data is summarized in TABLE 11 for both spruce and aspen wood.

The pulp fibers thus produced were first screened through a No. 6-cut flat screen and then beaten in various steps to 300 ml Csf (Canadian Standard Freeness, TAPPI T 227 Os-58) in a PFI (Papierindustriens Forsknings-institut) mill and standard handsheets were prepared according to the relevant TAPPI standard procedures. Sheet mechanical properties such as breaking length, tear and burst factor and zero-span tensile strength were also determined according to the relevant TAPPI standard testing procedures. On selected pulps a three-stage bleaching of CEH sequence was also carried and its effect on the pulp properties were also included in TABLE 11.

TABLE 11

PULPING RESULTS WITH ORGANOSOLV PULPING OF SPRUCE AND ASPEN CHIPS.

| PARAMETER | DEGREE OF DELIGNIFICATION 25-45 KAPPA | 45-65 KAPPA | 65-85 KAPPA | BLEACHED, CED* |
|---|---|---|---|---|
| COOKING TIME** min. | 30-180 | 15-90 | 10-50 | — |
| PULP YIELD, % | 54-60 | 58-65 | 62-78 | 54-66 |
| SCREEN*** REJECTS, % | 0.0 | 0.1-1.0 | 1.5-2.0 | — |
| ALPHA-CELLULOSE**** % | 44.1 | 44.3 | 44.5 | — |
| TAPPI 0.5% CuEn Viscosity, cP | 18-40 | 20-50 | 33-80 | 35-50 |
| PULP Breaking | 7.5-11.3 | 9.5-12.5 | 8.5-10.8 | 9.5-15.5 |

TABLE 11-continued

PULPING RESULTS WITH ORGANOSOLV PULPING OF SPRUCE AND ASPEN CHIPS.

| | | | | | |
|---|---|---|---|---|---|
| STRENGTH | length, km | | | | |
| 500/300 | Burst factor | 65–75 | 65–80 | 65–75 | 55–87 |
| ml | Tear factor | 120–65 | 120–65 | 125–90 | 113–83 |
| Csf | Zero-Span, km | 17.5–18.0 | 17.5–18.5 | 16.5–17.5 | 16.2–18.9 |

*65–85 Kappa No. pulp
**includes 11 min heating-up time
***No. 6-cut screen
****Value based on original wood as 100%

| PARAMETER | | DEGREE OF DELIGNIFICATION 25–45 KAPPA | 45–65 KAPPA | 65–85 KAPPA | BLEACHED, CED* |
|---|---|---|---|---|---|
| COOKING TIME*, min | | 20–40 | 10–30 | 5–20 | — |
| PULP YIELD, % | | 58–62 | 60–68 | 63–69 | NA |
| SCREEN** REJECTS, % | | 0.0 | 0.1 | 0.1–1.0 | — |
| ALPHA-CELLULOSE, % | | 47.8 | 48.0 | 48.1 | — |
| TAPPI 0.5% CuEn VISCOSITY, cP | | 20–40 | 25–50 | 30–53 | — |
| PULP STRENGTH | Breaking length, km | 8.3–11.0 | NA | NA | NA |
| 500/300 ml | Burst factor | 43–50 | NA | NA | NA |
| Csf | Tear factor | 76–71 | NA | NA | NA |
| | Zero-Span, km | 16.5–18.6 | NA | NA | NA |

*Includes 11 min heating-up time;
**No. 6-cut screen;
***values based on original wood 100%

Several of the higher-yield pulps were also delignified with sodium chlorite for 5 min according to TAPPI 230-su-66 in preparation for purification to an alpha-cellulose (TAPPI T 429-m-48 gravimetric) to estimate the 17.5% NaOH-resistant fraction remaining in the pulps. Spruce pulps averaged between 43.8 to 45.1 per cent alpha-cellulose based on dessiccated wood as 100, this value showing little if any variation with the actual pulp yield. Similarly, the TAPPI 0.5% CuEn viscosity (TAPPI T 230-Os-76) was also determined for these pulps to indicate the surprisingly low carbohydrate degradation by this process. Aspen pulps showed in comparable tests an alpha-cellulose content of 48% the dessiccated wood taken as 100 percent. The natural as cooked brightness of the pulps was 55 to 63% brightness GE for spruce and up to 70% for the low residual lignin content aspen pulps showing very little variation with varying levels of residual lignin.

In conjunction with these tests summative carbohydrate analyses were also carried out for the original wood of spruce and aspen poplar and the pulps prepared therefrom. Findings of these investigations are summarized in TABLE 12. Sugar composition of alpha-celluloses are those prepared from the pulps. The aspen pulp samples were found to be rich in xylan and spruce in mannan with the other less important hemicellulose being present in smaller amounts. Retention of these hemicelluloses explains the improvements in sheet strength and higher than usual yield had earlier with this process.

EXAMPLE 6

Selectivity for delignification is better achieved at thermodynamic conditions allowing or causing an increase in internal pressures higher than that normally found for enclosed liquids under free xpansion conditions, or by deliberate application of pressure from a pressure intensifier or through compressed inert gases was found to offset delignification and carbohydrate degradation rates at high alcohol water ratios and high temperatures by shifting the rate constants in a very favorable manner.

TABLE 12

SUGAR ANALYSES OF ASPEN AND SPRUCE WOOD, PULP AND ALPHA-CELLULOSE.

| SPECIES | SAMPLE | SUGAR CONCENTRATION, % GLUCOSE | XYLOSE | MANNOSE | GALACTOSE | ARABINOSE |
|---|---|---|---|---|---|---|
| ASPEN | HOLOCELLULOSE | 57.9 | 16.0 | 3.4 | 1.5 | 0.2 |
| | PULP* | 82 | 13.1 | 3.0 | TRACE | TRACE |
| | ALPHA-CELLULOSE | 97 (80)** | 1.0 | 1.0 | TRACE | TRACE |
| SPRUCE | HOLOCELLULOSE | 49.9 | 6.0 | 11.9 | 2.6 | 1.1 |
| | PULP*** | 76 | 4.8 | 10.7 | TRACE | TRACE |
| | ALPHA-CELLULOSE | 97 (87)** | 0.5 | 2.3 | TRACE | TRACE |

*2.0% residual lignin;
**denotes proportion of glucan originally present in wood;
***8.5% residual lignin.

In general it was observed, that in order to achieve the same degree of delignification at high alcohol water ratios especially over 85:15, higher temperatures were required. Thus desired delignification rates could be maintained and cooking times could be held within reasonable limits. It was also found that as the system pressure increased so did the pulp viscosity indicating the beneficial effects of pressure on delignification rates and on lowering the sensitivity of the carbohydrates to increased thermal treatment which normally led to lower viscosities. It was also observed that the pressure effects were not linked to increased penetration into the wood matrix since when air-dry chips are cooked with 90:10 or 95:5 alcohol: water solvent mixtures in the presence of 0.05 moles of $CaCl_2$ at 210° C. under normal pressure (35 atm and 39 atm, respectively) complete penetration of the chips is observed within the first 10 min of cooking yet no fiber separation occurs even after prolonged cooking, up to 50 min. Under the same conditions, but with added or internally generated overpressure, fully cooked chips are obtained which show the same fiber liberation tendencies as chips cooked at lower alcohol concentration (under 80:20). While this in itself was a surprising effect, analysis of the resulting pulps showed a consistently higher pulp viscosity, in fact the pulp viscosity consistently increased with the level of pressure applied or generated. Some data on high pressure cooks is reproduced in TABLE 13. In comparison to previous test data provided in TABLE 7 the increased selectivity of delignification and the lower carbohydrate degradation (higher pulp viscosity) and a significant reduction in cooking time is clearly evident. Thus the compounded effect of high alcohol concentration and high pressure becomes the most important aspect of this invention in that it allows now the delignification of any wood species to residual lignin content levels which were not possible without considerable losses in cellulose viscosity. The pressure effect somewhat diminishes when solvent compositions lower than 60:40 alcohol:water content are used.

TABLE 13

EFFECT OF INCREASED PRESSURE ON DELIGNIFICATION RATES AND CARBOHYDRATE DEGRADATION AT VARIOUS ALCOHOL:WATER RATIOS ON COOKING SPRUCE WOOD.

| LIQUOR COMP.* | COOKING TEMP. °C. | COOKING PRESSURE atm | COOKING TIME min | YIELD % | KAPPA NO. | TAPPI 0.5% Viscosity cP |
|---|---|---|---|---|---|---|
| 70:30 | 190 | 265 | 30 | 72 | 82 | 70 |
| 70:30 | 190 | 265 | 50 | 64 | 70 | 58 |
| 70:30 | 190 | 265 | 70 | 59 | 48 | 53 |
| 70:30 | 190 | 23 | 70 | 64 | 71 | 48 |
| 70:30 | 190 | 23 | 90 | 61 | 61 | 44 |
| 80:20 | 210 | 285 | 25 | 60 | 41 | 57 |
| 80:20 | 210 | 285 | 30 | 57 | 45 | 47 |
| 80:20 | 210 | 285 | 35 | 52 | 27 | 26 |
| 80:20 | 210 | 33 | 25 | 61 | 63 | 55 |
| 80:20 | 210 | 33 | 30 | 59 | 56 | 40 |
| 80:20 | 210 | 33 | 35 | 57 | 45 | 38 |
| 90:10 | 210 | 320 | 20 | 75 | 86 | 62 |
| 90:10 | 210 | 320 | 25 | 69 | 71 | 50 |
| 90:10 | 210 | 320 | 35 | 63 | 62 | |
| 90:10 | 210 | 320 | 60 | 57 | 36 | |
| 90:10 | 210 | 40 | 35 | 59 | 100 | 24 |
| 90:10 | 210 | 40 | 80 | 52 | 100 | 10 |

All cooks were done at a wood:liquor ratio of 1:10. Cooking times include 9 min for heating-up to temperature. In a similar series of cooks with 90:10 alcohol:water mixture, cooked at 210° C. and 320 atm it was established that the ratio of lignin to carbohydrate removed can be as high as 9.48 on spruce wood and delignification could be pursued to a Kappa number of 14.5 at a residual pulp yield of 49%. The viscosity dropped from an initial value of 55 cP to 24 on cooking for 50 min under the above conditions. Thus the pulp properties generally increase with increased overpressure at the lowest temperatures possible. Interestingly, the alpha-cellulose yield of the highly delignified pulp was still 43.2% based on wood as 100, representing 88% of the total pulp mass.

As can be seen from the foregoing description and Examples, the present invention provides a very effective and efficient pulping process.

We claim:

1. In a process for converting lignocellulosic plant material to the form of separated fibers in which the plant material is cooked in a confined chamber at elevated pressure in the absence of added oxygen with an initially neutral or acidic aqueous mixture of a lower aliphatic alcohol having one to three carbon atoms at elevated temperature, the improvement which consists essentially of the steps of:

(a) cooking fragmented lignocellulosic material with an aqueous solvent mixture containing a major volume proportion of the alcohol and containing a catalytic amount of a magnesium, calcium or barium salt of a strong inorganic acid or mixtures thereof which promotes separation of the fibers in the lignocellulosic material in the solvent mixture at elevated temperatures as a primary catalyst which is soluble in at least the catalytic amount in the mixture to form magnesium, barium and calcium ions dissolved therein at an elevated temperature between 145° C. and 240° C. and optionally a catalytic amount of an acidic compound as a secondary catalyst;

(b) maintaining the cooking temperature for at least 2 minutes and sufficient to effect at least partial depolymerization and dissolution of lignin and hemicellulose and other cell wall constituents encrusting the cellulose fibers and to render the fibers separable from each other to produce a pulp which has a 0.5 CuEn Tappi viscosity of 14 or above; and (c) recovering the separated fibers, lignin materials and sugars from liquor residue.

2. The process of claim 1 wherein the salt is selected from the group consisting of magnesium chloride, magnesium nitrate and magnesium sulphate salts and of calcium chloride and calcium nitrate salts and the concentration of the salt in the solvent cooking mixture is between about 0.005 and 0.5 moles per liter.

3. The process of claim 1 wherein the alcohol is selected from the group consiting of methanol, ethanol and n-propanol with a volume ratio of the alcohol to water in the range from 50 to 50 to 98 to 2, and wherein the lignocellulose is between ¼ and 1/20 weight of the solvent mixture.

4. The process of claim 1 wherein the alcohol is methanol with a ratio by volume of the alcohol to water in the range from 80 to 20 to 98 to 2.

5. The process of claim 1 wherein the cooking temperature is between about 170° C. and 240° C.

6. The method of claim 1 wherein the solvent mixture contains an added acidic compound as a secondary catalyst and wherein the amount of the acid is 10% or less than the weight of the salt.

7. The process of claim 6 wherein the acidic compound is selected from perchloric and sulfuric acids in concentrations ranging between a trace amount and about 0.01 normal.

8. The process of claim 6 wherein the acidic compound is selected from strong mineral acids, weak mineral acids having a pK below 4.0, organic acids having a pK below 4.75 and acidic salts.

9. The process of claim 6 wherein the acids are selected from oxalic, salicylic, maleic, succinic,o-phthalic, benzoic acids at a concentration between a trace and about 0.05 Molar.

10. The method of claim 6 wherein the acidic compound is an acidic metal salt in a concentration between a trace and about 0.025 Molar.

11. In a process for converting lignocellulosic plant material to the form of separated fibers in which the plant material is cooked in a confined chamber at elevated pressure in the absence of added oxygen with an initially neutral or acidic aqueous mixture of a lower aliphatic alcohol having one to three carbon atoms at elevated temperature, the improvement which consists essentially of the steps of;

(a) cooking fragmented lignocellulose with an aqueous solvent mixture containing a major volume proportion of the alcohol and containing a catalytic amount of a magnesium, calcium or barium salt or mixtures thereof which promotes separation of the fibers from the lignocellulose material in the solvent mixture at elevated temperatures as a primary catalyst in amount dissolved therein at an elevated temperature between 145° C. and 240° C., the salt including anions selected from the group consisting of chloride, nitrate and sulphate which is soluble in at least the catalytic amount in the mixture to form magnesium, calcium and barium ions and a catalytic amount of an acidic compound as a secondary catalyst wherein the catalytic amount of the salt is between about 0.005 and 0.5 molar and the catalytic amount of the acid compound is between about 0.0001 and 0.01 normal and wherein the amount of the acid is 10% or less than the weight of the salt;

(b) maintaining the cooking process at the cooking temperature for at least 2 minutes and sufficient to effect at least partial depolymerization and dissolution of lignin and hemicellulose and other cell wall constituents encrusting the cellulose fibers and to render the fibers separable from each other in a liquor residue containing deissolved lignin materials and sugars to produce a pulp which has a Tappi 0.5 CuEn viscosity of 14 or above; and (c) recovering the separated fibers, lignin materials and sugars from the liquor residue.

12. The process of claim 11 wherein the cooking temperature is in the range from about 170° C. to about 240° C.

13. The process of claim 11 wherein the plant material in step (a) initially comprises between ¼ and 1/20 by weight of the solvent mixture.

14. The process of claim 11 wherein the salt is selected from the group consisting of the magnesium and calcium chloride and nitrate and magnesium sulphate.

15. The process of claim 11 wherein the salt is selected from the goup consisting of magnesium chloride, magnesium nitrate, calcium chloride, calcium nitrate and magnesium sulfate, and the acidic compound is strong acid added in amount to render the solvent mixture between 0.001 to 0.01 Normal with respect to the acid, and wherein the anion of the acid corresponds to the anion of the metal salt.

16. The process of claim 11 wherein the salt is calcium chloride.

17. The process of claim 11 wherein the salt is calcium nitrate.

18. The process of claim 11 wherein the salt is magnesium chloride.

19. The process of claim 11 wherein the salt is magnesium nitrate.

20. The process of claim 11 wherein the salt is barium chloride.

21. The process of claim 11 wherein the salt is barium nitrate.

22. The process of claim 11 wherein the salt is magnesium sulphate.

23. The process of claim 11 wherein the recovered fibers are cleansed by washing with acetone and then with water.

24. The process of claim 11 wherein the recovered fibers are cleansed by washing with methanol-water mixture and then with water.

25. The process of claim 11 wherein the alcohol is methanol or ethanol or mixtures thereof with an alcohol-water volume ratio in the range from 50 to 50 to 98 to 2 with a ratio by weight of the plant material to solvent mixture in step (a) initially of between ¼ and 1/20, and wherein the cooking temperature is between about 170° C. and 220° C.

26. In a process for converting lignocellulosic plant material to the form of a separable-fiber cellulosic residue in which the plant material is cooked in a confined chamber at elevated pressure in the absence of added oxygen with an initially neutral or acidic aqueous mixture of a lower aliphatic alcohol having one to three carbon atoms at elevated temperature, the improvement consists essentially of the steps of:

(a) cooking fragmented lignocellulosic material with an aqueous solvent mixture containing a major volume proportion of alcohol and containing a magnesium, calcium or barium salt or mixtures thereof which promotes separation of the fibers from the lignocellulosic material in the solvent mixture at elevated temperatures as a primary catalyst in a catalytic amount dissolved therein in a concentration of between about 0.005 and 0.5 molar, the salt including anoins selected from the group comsisting of the chloride, nitrate and sulphate and which is soluble in at least the catalytic amount in the mixture to form magnesium, calcium and barium ions, and with a catalytic amount of a strong acid as a secondary catalyst in concentration between about 0.0001 to and 0.01 Normal, at an elevated temperature between 145° C. and 240° C.;

(b) maintaining the cooking process at the cooking temperature for at least 2 minutes and sufficient to effect at least partial depolymerization and dissolution of the lignin and hemicellulose and other fiber cell wall constituents encrusting the cellulose fibers to produce a separable-fiber cellulosic residue to produce a pulp which has a Tappi 0.5 CuEn viscosity of 14 or above; and (c) recovering the cellulosic residue, lignin and sugars from the liquor residue.

27. The process of claim 23 wherein the aliphatic alcohol is methanol or ethanol or mixtures thereof, the solvent mixture comprises a volume ratio of alcohol to water between 50 to 50 to 98 to 2, with a weight ratio of plant material to solvent mixture in step (a) initially between ¼ and 1/20, the cooking temperature is between 170° C. and 220° C., and the salt is selected from the group consisting of the chloride and the nitrate salts of calcium and magnesium and the sulphate salt of magnesium in concentration between about 0.01 to 0.10 molar.

28. The process of claim 26 wherein the solvent mixture contains a concentration of acid between 0.002 Normal and 0.008 Normal.

29. The process of claim 26 wherein the anion of the salt corresponds to the acid.

* * * * *

UNITED STATES PATENT AND TRADEMARK OFFICE

CERTIFICATE OF CORRECTION

PATENT NO. : 4,594,130

DATED : June 10, 1986

INVENTOR(S) : Pei-Ching Chang and Laszlo Paszner

It is certified that error appears in the above-identified patent and that said Letters Patent are hereby corrected as shown below:

Face sheet under References Cited "Zeehiusen" should be --Zeehuisen--.

Column 11, Table 3 under heading "TAPPI 0.5%-Visc. cP" at line 9, should be --25--.

Column 11, Table 4 under heading "Alcohol to Water Ratio", "70:3-" should be --70:30--.

Column 21, Table 11, line 19 under "25-45 KAPPA", "43-50" should be --43-60--.

Column 26, line 51, "anoins" should be -- anions --.

Column 26, line 52, "comsisting" should be -- consisting --.

Signed and Sealed this

Twentieth Day of January, 1987

*Attest:*

*Attesting Officer*

DONALD J. QUIGG

*Commissioner of Patents and Trademarks*